US007832075B2

(12) United States Patent
De Guerry et al.

(10) Patent No.: US 7,832,075 B2
(45) Date of Patent: Nov. 16, 2010

(54) METHOD FOR PRODUCING DECORATED BOTTLE CAPS WITH IMPROVED MECHANICAL STRENGTH

(75) Inventors: Jean De Guerry, Libourne (FR); Raymond Guicheney, Galgon (FR)

(73) Assignee: Alcan Packaging Capsules, Courbevoie (FR)

( * ) Notice: Subject to any disclaimer, the term of this patent is extended or adjusted under 35 U.S.C. 154(b) by 970 days.

(21) Appl. No.: 11/557,015

(22) Filed: Nov. 6, 2006

(65) Prior Publication Data

US 2007/0107190 A1 May 17, 2007

Related U.S. Application Data

(63) Continuation-in-part of application No. PCT/FR2005/001091, filed on May 2, 2005.

(30) Foreign Application Priority Data

May 6, 2004 (FR) ..... 04 04885

(51) Int. Cl.
*B23P 25/00* (2006.01)

(52) U.S. Cl. ..... 29/458; 29/469.5; 29/527.1; 72/349

(58) Field of Classification Search ..... 29/458, 29/469.5, 527.1, DIG. 11; 72/349; 215/258, 215/329, 346

See application file for complete search history.

(56) References Cited

U.S. PATENT DOCUMENTS 5,255,805 A * 10/1993 Weiss et al. ..... 215/274
5,282,306 A * 2/1994 Katsuhiro et al. ..... 29/469.5

FOREIGN PATENT DOCUMENTS

| | | | |
|---|---|---|---|
| EP | 0475856 | A | 3/1992 |
| EP | 0615915 | A | 9/1994 |
| EP | 1254059 | B | 11/2002 |
| FR | 2836158 | A | 8/2003 |
| GB | 203976 | A | 9/1923 |
| WO | 02/43781 | A | 6/2002 |

* cited by examiner

*Primary Examiner*—Thiem Phan
(74) *Attorney, Agent, or Firm*—Dennison, Schultz & MacDonald

(57) ABSTRACT

A method comprising: a) providing sheet or format metal; b) swaging said metal by means of a swaging lubricant, so as to form a swaged blank; c) degreasing said swaged blank, so as to typically remove the remains of the swaging lubricant, to form a degreased blank capable of being lacquer coated; d) lacquer coating said degreased blank, said resulting lacquer coated blank being then optionally decorated; e) an optional finishing step. The method is characterized in that during the degreasing at step c), said swaged blank is subjected to an energetic radiation emission treatment of selected intensity and duration to eliminate or decompose said remains of lubricant, said treatment being wholly carried out at a metal temperature less than 150 degree C., and for a duration typically less than 1 second, so as to obtain, following said treatment, a surface tension not less than 34 dynes/cm.

21 Claims, 3 Drawing Sheets

METHOD FOR PRODUCING DECORATED BOTTLE CAPS WITH IMPROVED MECHANICAL STRENGTH

CROSS-REFERENCE TO RELATED APPLICATIONS

This application claims priority to (1) Patent Cooperation Treaty patent application Serial Number PCT/FR2005/001091, filed on May 2, 2005, which is incorporated herein by reference, (wherein Patent Cooperation Treaty patent application Serial Number PCT/FR2005/001091 was not published under PCT Article 21(2) in English) and (2) French patent application no. FR 0404885, filed on May 6, 2004, which is incorporated herein by reference.

BACKGROUND OF THE INVENTION

Field of the Invention

The invention relates to the field of sealing caps or oversealing caps, and typically aluminium-based or tin-based metal caps. The invention relates particularly to a process for manufacturing these caps.

Metal sealing caps, typically made of aluminium, can be produced as follows:

- a drawing press forms deep-drawn blanks from flat blanks that are typically cut by punching a metal coil varnished on both sides, with a typical thickness ranging from 0.21 to 0.25 mm,
- the blanks are degreased in a stove at high temperature, typically from 180 to 210° C., for a time ranging from 3 to 5 minutes, so as to remove the drawing lubricant,
- the blanks are then lacquer coated over their external surface and are placed in a stove in order to bake the lacquer,
- the lacquered blanks are printed on the skirt, typically offset, with a final drying of the inks in a stove,
- an overprint varnish is finally applied to the impression so as to protect it, the varnish being dried in a stove,
- the blank thus obtained is equipped with a threaded interior plastic insert and/or a seal.

As regards the metal caps, whether they are sealing caps or oversealing caps, there is a constant need both to reduce the production costs, so that they will not be replaced by other more economical caps produced by different technology and a different material, and to improve the decorations and their service life.

Embodiments of this invention address these two problems.

BRIEF SUMMARY OF EMBODIMENTS OF THE INVENTION

According to an embodiment of the invention, a method for producing metal caps, typically made of aluminium, can include the steps of:

a) providing a flat blank, typically cut by punching a metal coil or sheet, said flat blank being typically coated on both sides with a layer of drawing varnish, b) drawing, in one or more stages, the flat blank, typically using a drawing lubricant, so as to form a deep-drawn blank including a head and a skirt, having typically a rotational symmetry round an axial direction 10, c) degreasing the deep-drawn blank, so as typically to remove the remainder of the drawing lubricant, in order to form a degreased blank capable of being lacquered, d) lacquering the degreased blank, said lacquered blank thus obtained then optionally being decorated, e) performing an optional finishing step, wherein the deep-drawn blank is subjected during the degreasing step c) to an energy radiation emission treatment of selected intensity and duration so as to eliminate or break down the remaining lubricant, the treatment being carried out entirely at a metal temperature of less than 150° C., and for a time typically less than 1 s, so as to obtain, after the treatment, a surface tension equal to at least 33 dynes/cm, and typically equal to at least 34 dynes/cm.

The treatment, on the one hand, can be carried out at room temperature, which can be advantageous with regard to both energy savings and the disadvantages of metal softening, and, on the other hand, can be carried out in concurrent operation time insofar as it can be implemented by being associated with all or part of a decoration step, without slowing the rate of the decoration step, so that the degreasing step does not in itself constitute a step, and is therefore a very economical operation.

BRIEF DESCRIPTION OF THE FIGURES

FIG. 2*a* is a cross-section along the axis of rotation 530 of the support 53' of the blank.

FIG. 2*b* is a cross-section in a plane perpendicular to the axis of rotation 530.

FIG. 3*a* is a cross-section along the axis of rotation 520 of the support 52' of the blank 1.

FIG. 3*b* is a top view of the head 11, the electrode 40, 40' being shown with dotted lines.

In FIGS. 2*a* to 3*b*, the arrows between the electrodes 40, 40', 40" and the blank 1 represent the plasma 58 formed, the distance d between the electrodes and the blank being exaggerated so as to show the plasma 58.

List of References

Figure 1A:
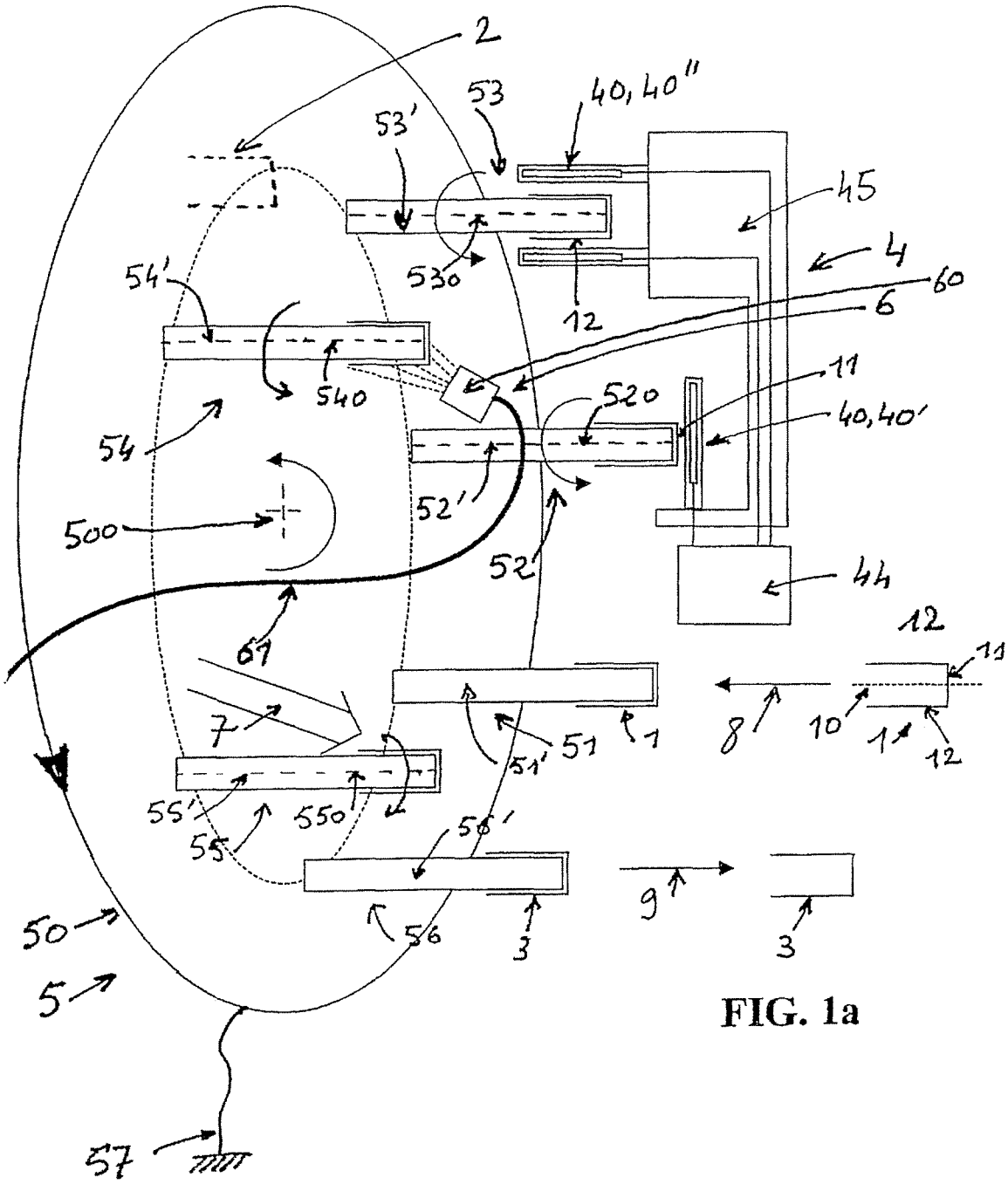
FIG. 1*a* is a perspective view diagrammatically showing a device for implementing the method according to an embodiment of the invention.

The following is a list of references found in the figures:

| | |
|---|---|
| Deep-drawn blank to be degreased | 1 |
| Axial direction | 10 |
| Head | 11 |
| Skirt | 12 |
| Degreased deep-drawn blank | 2 |
| Degreased and lacquered blank | 3 |
| Degreasing treatment device | 4 |
| Emission electrode or bar | 40 |
| Frontal electrode - bar parallel to 11 | 40' |
| Lateral electrode - bar parallel to 12 | 40" |
| Metal core | 41 |
| Dielectric ceramic sheath | 42 |
| Supply conductor cable | 43 |
| High-voltage & high-frequency generator | 44 |
| Support for electrodes 40, 40', 40" | 45 |
| Treatment device | 5 |
| Step by step rotating plate | 50 |
| a) Rotation axis | 500 |

-continued

| | |
|---|---|
| Station for loading 1 | 51 |
| Support lug for 1 | 51' |
| Station for treatment of 11 | 52 |
| Support lug for 1 | 52' |
| a) Rotation axis | 520 |
| Station for treatment of 12 | 53 |
| Support lug for 1 | 53' |
| a) Rotation axis | 530 |
| Station for lacquering of 2 | 54 |
| Support lug for 2 | 54' |
| a) Rotation axis | 540 |
| Drying station | 55 |
| Support lug for 2 | 55' |
| a) Rotation axis | 550 |
| Station for ejection of 3 | 56 |
| Support lug for 3 | 56' |
| Grounding | 57 |
| Plasma | 58 |
| Lacquering device | 6 |
| Spray nozzle | 60 |
| Supply line | 61 |
| Drying device | 7 |
| Device for supplying blanks 1 | 8 |
| Device for transfer (to printing line) | 9 |

DETAILED DESCRIPTION OF EMBODIMENTS OF THE INVENTION

According an embodiment of the invention, an energy radiation treatment can be a treatment including the formation of a plasma or an ionic or electronic discharge. The treatment can be a treatment typically using a high electric field, typically equal to at least 5 kV, and a high-frequency current, typically equal to at least 10 kHz. Preferably, and as shown in FIG. 1*a*, the treatment can be performed using two bars or electrodes 40 for emission of the discharge, a lateral electrode 40", typically parallel to the skirt 12, intended to reach and treat the skirt 12, and a frontal electrode 40', substantially perpendicular to the lateral electrode 40" and parallel to the head 11, intended to reach and treat the head 11.

Figure 1B:
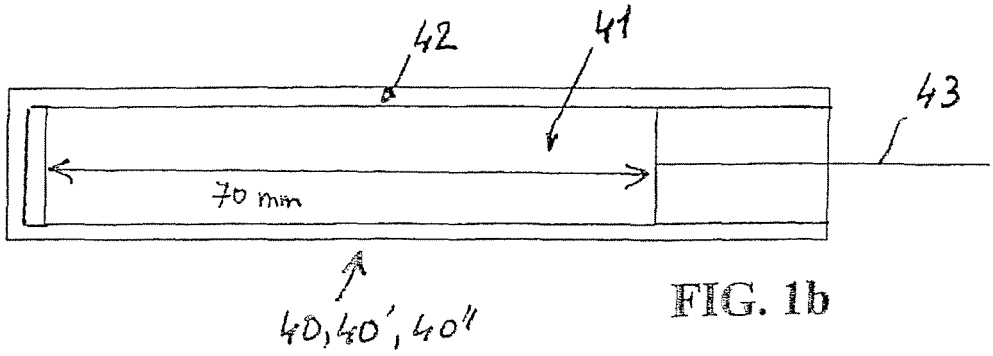
FIG. 1*b* is an axial cross-section view of an electrode used in the method according to an embodiment of the invention.

As shown in FIG. 1*b*, the electrodes 40, 40', 40", in an embodiment, can include an electrically conductive metal core 41 covered with a dielectric ceramic layer 42. It has been found that this type of electrode 40 can be particularly suitable for treating the exterior metal surface of the deep-drawn blanks 1, so as to detach it from the shaping lubricant residue, and to then allow for the adhesion of a lacquer.

The applicant was able to observe that the treatment according to embodiments of the invention, both under high voltage and at a high frequency, carried out at room temperature and in ambient air, was economical due to the low energy consumed, the installed power being around 500 W, reliable, relatively danger-free in its implementation, and relatively non-aggressive for the metal because, with the electrodes used, the discharge emitted is regularly distributed over the entire length of the electrode opposite the cap 1, so that there is no risk of "breakdown" with a localised current flow point that could damage an area of the blank 1.

In an embodiment, the treatment can be carried out with a potential difference between the electrodes 40, 40', 40" and the deep-drawn blank 1, typically ranging from 10 to 30 kV, so as to form the high electric field, the electrodes 40, 40', 40" being brought to a potential of 10 to 30 kV and the blank 1 being at the ground or at a zero potential, the potential difference serving to regulate the intensity of the treatment, the electrodes 40, 40', 40" being at a distance "d" from the surfaces of the blank 1 to be treated of less than 4 mm.

Figure 2B:
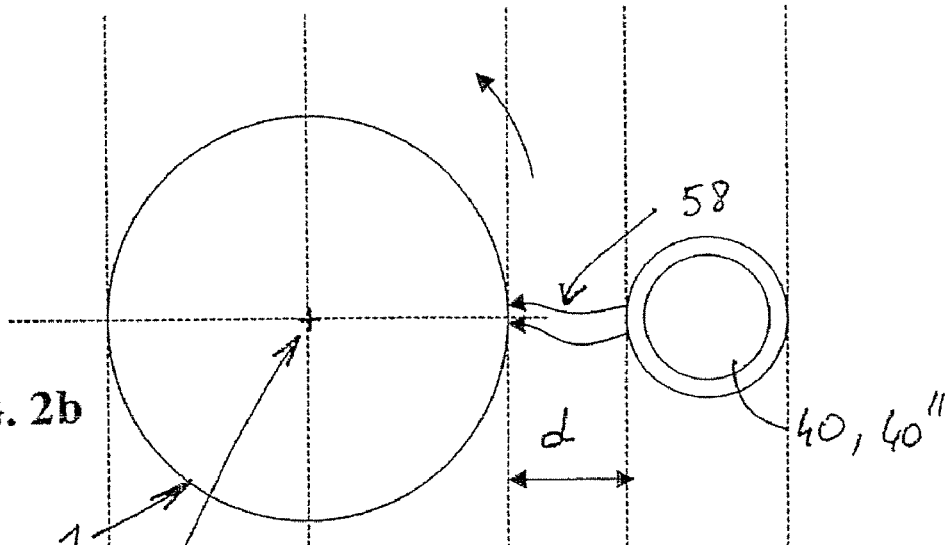
FIGS. 2*a* and 2*b* diagrammatically and partially show the station 53 for degreasing the skirt 12 of the blank 1 of FIG. 1*a*.
Figure 2A:
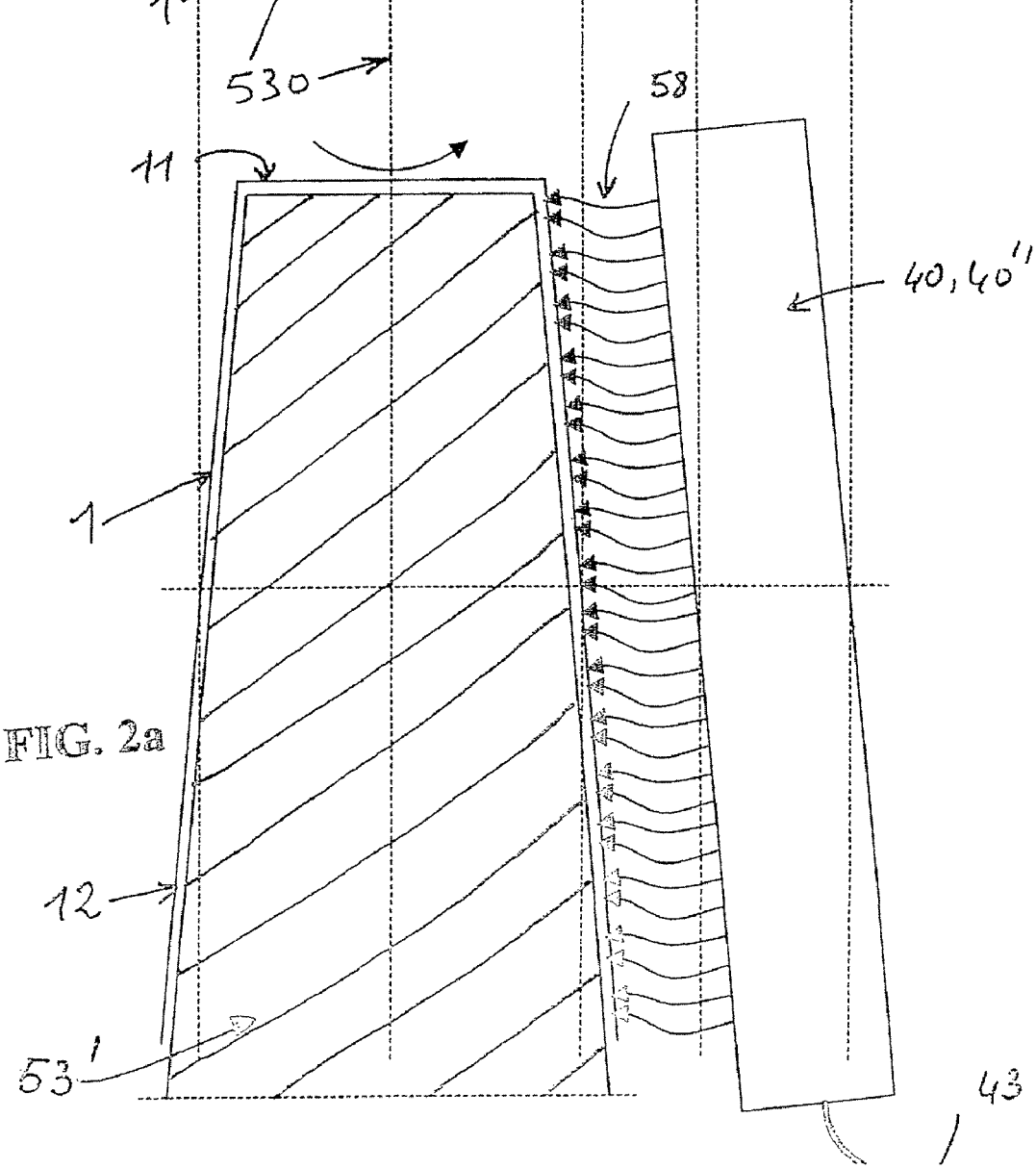
Figure 3A:
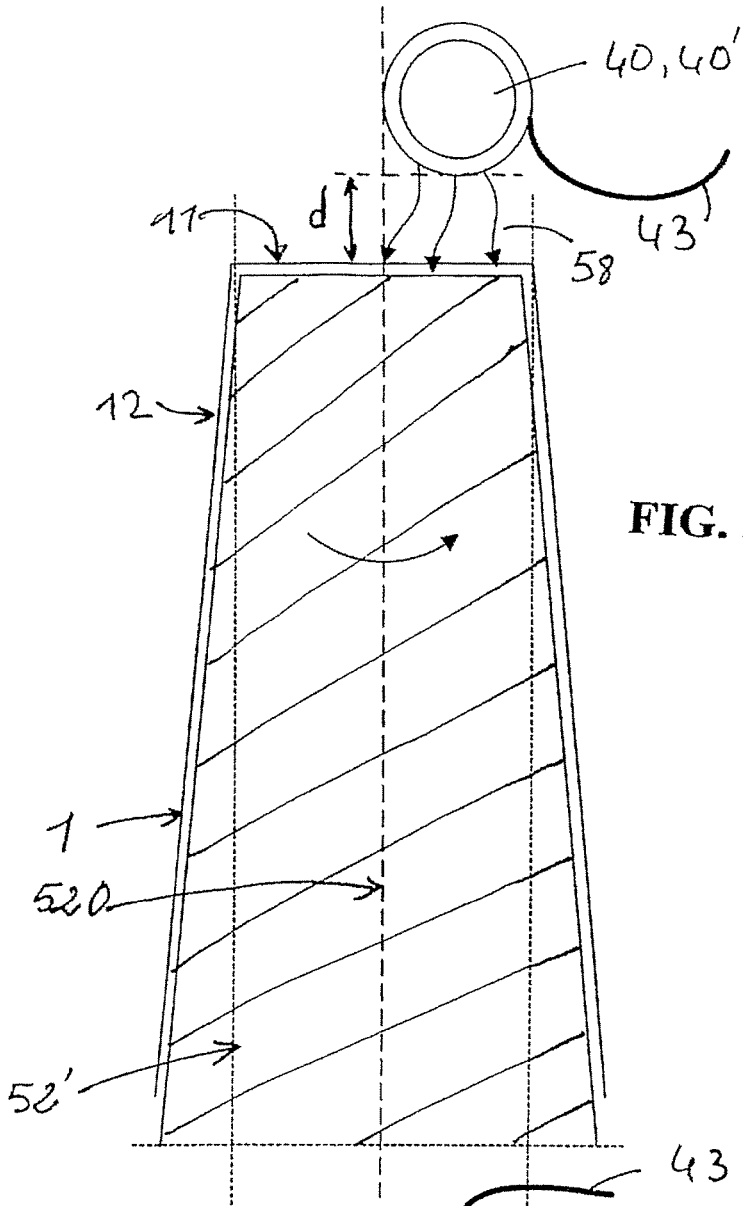
FIGS. 3*a* and 3*b* diagrammatically and partially show the station 52 for degreasing the head 11 of the blank 1 of FIG. 1*a*.
Figure 3B:
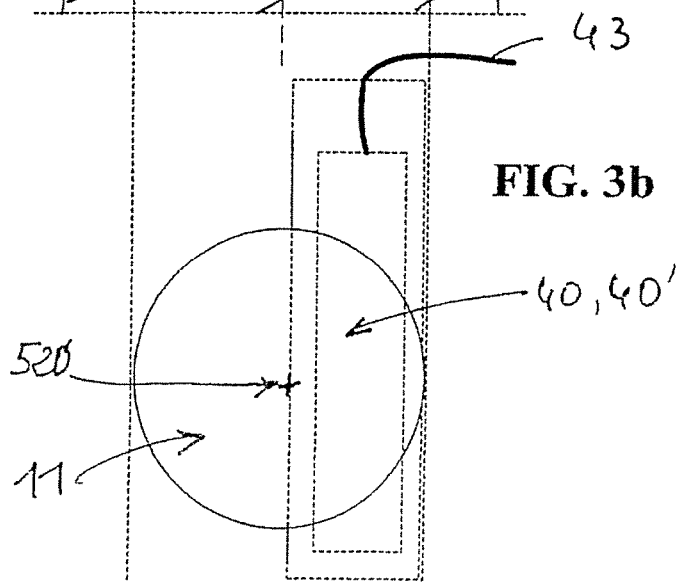

As shown in FIG. 1*a* and in FIG. 2*a*, the lateral electrode 40" can be arranged so that it is parallel to a generatrix of the skirt 12, so that, by rotation of the blank 1, the entirety of the skirt 12 is subjected to the energy radiation emitted by the lateral electrode 40", uniformly over the entire height of the skirt 12.

The rotation of the blank 1 can take place over 1 or 2 rotations, for a time of no more than 1 second, the blank rotating about itself, having been placed on an arm or a lug 52', 53' rotating about itself according to an axis of rotation 520, 530.

According to an embodiment of the invention, the treatment can also be a so-called "cold" plasma treatment, typically carried out at atmospheric pressure.

It can be advantageous that the treatment, in certain embodiments, can be carried out at room temperature, typically on a line, without requiring a particular gaseous atmosphere, so as to limit the investment and operation costs.

The lubricant can include a volatile organic solvent and a lubrication compound capable of breaking down rapidly under the action of said treatment. The compound can be a paraffin oil.

As shown in FIG. 1*a*, the lacquering step can include a so-called spray-painting step in which typically the entirety of an external surface of the degreased blank is covered with a lacquer by spraying or by application with a spray-paint gun, so as to form a lacquered blank 3. The spray-painting step can be followed by a first so-called "dust-free" drying step at a temperature below 100° C. and typically at a temperature of 80° C., for a time of less than 2 minutes, so that the lacquered blank 3 can then be directly decorated or printed. Between the degreasing step and the spray-painting step, a time $\Delta t$ of less than 15 minutes, typically less than one minute, and possibly less than 10 seconds can pass.

According to an embodiment of the invention, the lacquered blank 3 can be printed, typically by screen printing, but optionally by offset printing or by flexographic printing, on its skirt 12 and optionally on its head 11, then subjected to a second drying operation, typically at a temperature of 140° C., for a time typically less than four minutes, so as to obtain a printed cap. Advantageously, to enhance the decoration of the final cap, a relief pattern can be formed on the head 11 of the blank 1, 2, 3 or of the printed cap, the relief pattern typically being formed with a punch-and-die set having the pattern.

In an embodiment, the metal of the flat blanks can be aluminium, such as of the 8000 series, with a temper typically ranging from 1/4 hard temper to 3/4 hard temper, and with a thickness ranging from 0.18 mm to 0.30 mm, and preferably from 0.21 mm to 0.25 mm.

The finishing step, in aspects of the invention, can include in particular, typically if the cap is a sealing cap, at least one of the additional means, which include:

- the incorporation of a seal ring,
- the incorporation of a screw insert,
- the formation of means for facilitating a first opening, typically including at least one break-off line.

As shown in FIGS. 1*b* and 2*a* to 3*b*, the electrode 40, 40', 40" can be a cylindrical electrode with an exterior diameter typically ranging from 15 mm to 20 mm, and with a length ranging from 100 to 150 mm, with a metal core 41 having a length ranging from 50 to 90 mm, the electrode 40, 40', 40" including an external dielectric ceramic layer or sheath 42 having a thickness ranging from 0.5 to 3 mm, in embodiments of the invention.

According to embodiments of the invention, the electrode 40, 40', 40" can be placed at the distance d from the blank 1, that is, either from the head 11 or from a generatrix of the skirt 12, the distance d ranging from 0.2 to 4 mm, and typically from 1 mm to 2 mm. The tests were generally carried out with d=1.5 mm.

Embodiments of the invention also can relate to sealing caps formed by the method according to the invention. Embodiments of the invention also can relate to oversealing caps formed by the method according to the invention. Embodiments of the invention also can relate to a use of the method according to the invention in order to form sealing caps or oversealing caps.

Embodiments of the invention also can relate to a device 5 for continuously implementing the method for degreasing blanks 1 according to the invention. As shown in FIG. 1*a*, this device 5 can include a mobile support for the blanks, typically a plate 50 rotating about a rotation axis 50, typically step by step, and equipped with a plurality of stations with means or arms for supporting 51', 52', 53', 54', 55' the blanks 1, the plurality of stations including:

- a loading station 51 downstream of a device 8 for supplying blanks 1 to be degreased,
- a station for degreasing 51, 52 the blanks 1, the blanks 1 being rotated about themselves opposite stationary degreasing electrodes 40, 40', 40" at a predetermined distance d, the electrodes 40, 40', 40" being powered by a current at a predetermined frequency and voltage capable of generating a discharge to destroy the lubricant remains or residue, the blanks 1 being grounded so as to obtain deep-drawn and degreased blanks 2,
- a station for ejection or discharge 56 of the degreased blanks 2.

The degreasing station can include two treatment stations, a first station 51 for treatment of the head 11 of the blank 1 to be degreased 1 and a second station 52 for treatment of the skirt 12, typically with a separate treatment of the head 11 and the skirt 12 of the blank 1 to be degreased 1.

The plurality of stations also can include, after the degreasing station(s), a lacquering station 54 and a drying station 55.

EXAMPLES

In one example, the continuous treatment device 5 according to FIGS. 1*a* and 1*b* was developed. Upstream, this device was supplied, at the station 51, with blanks as they were discharged from the drawing press. These deep-drawn blanks 1 were formed from an aluminium coil varnished on both sides, the drawing having been performed with a lubricant forming a solution of a mineral oil in an alcoholic medium.

The degreasing treatment was performed either with an STT-brand apparatus (SG2-type) at a fixed frequency (40 kHz) and a variable power of 0 to 715 W, or with a Softal-brand apparatus (type 3003) at a variable frequency between 16 kHz and 40 kHz, and with 4 power positions (366 W, 426 W, 493 W and 500 W).

The STT apparatus was used at 50% of its power, i.e. 350 W, while the Softal apparatus was used with a power of 500 W.

An electrode 40, 40', 40" with a working length of 70 mm, as shown in FIG. 1*b*, was used.

The degreasing device 4 includes, as shown in FIG. 1*a*, a high-voltage and high-frequency current generator 44, a stationary support 45 for electrodes 40 and electrodes 40', 40" arranged so that, at each fraction of a rotation or step of the rotating plate 50, a blank 1 is positioned at the distance "d" from the electrodes.

Typically, the duration of the degreasing treatment was 0.55 seconds, the blank 1 performing 1 to 2 rotations about itself.

In these tests, the distance "d" was fixed at 1.5 mm.

As shown in FIGS. 2*a* to 3*b*, a plasma 58 is formed at the surface of the blank 1 to be treated, at room temperature in ambient air. Such a plasma can be visually observed laterally by the presence of a light emission forming a uniform blue layer covering the metal surface treated.

The blanks 1 are placed on lugs 51', 52', 53', 54', 55', 56' rotating about themselves in certain stations 52, 53, 54, 55 around an axis of rotation 520, 530, 540, 550. In consideration of the experimental parameters, it was calculated that the electrical energy received by the blanks 1 was up to 7.8 J/cm$^2$ with the STT device and 4 J/cm$^2$ with the Softal device.

Downstream of this device 5, the degreased and lacquered blanks ejected from the station 55 were directed toward a silkscreen printing machine, so as to obtain printed caps.

Downstream of this device 5, the blanks were also subjected to various types of finishing operations: the formation of a relief, typically on the head 11, but possibly on the skirt 12 of the blank 2, 3 or of the final cap, or the formation of means intended to facilitate a first opening, means including at least one break-off line.

This device 6 was used to produce oversealing caps and sealing caps, the sealing caps being equipped with a seal or a threaded insert.

On the degreased blanks 2, the surface tension was measured and it was observed that it ranged from 34 dynes/cm to 36 dynes/cm, the starting blanks 1 having a surface tension ranging from 30 to 32 dynes/cm.

On the lacquered blanks 3, abrasion tests and tests of pulling the lacquer with adhesive tape were performed.

All of these tests showed excellent adherence of the lacquer on the degreased metal according to the invention.

Embodiments of the invention can provides advantages. Indeed, the method according to embodiments of the invention makes it possible to avoid using treatments that are costly in terms of investment and operating costs, in particular with regard to the energy consumed. This method also prevents any softening of the metal constituting the starting metal blank and any loss of its mechanical characteristics. Therefore, it was possible to reduce the thickness of the metal blank by 5 to 10%.

Finally, embodiments of the invention make it possible to avoid using large equipment, so that the treatment according to embodiments of the invention can correspond to a minimal investment cost and to a minimal space occupied, which can make it possible to use a very compact production workshop, not to mention that the treatment can be carried out continuously and in concurrent operation time, so that it does not involve specific production costs, the cost of the energy consumed being negligible.

The invention claimed is:

1. A method for producing aluminum metal caps, comprising:

a) providing a flat blank cut by punching a metal coil or a metal sheet, the flat blank coated on both sides with a layer of drawing varnish, b) drawing, in one or more stages, the flat blank, using a drawing lubricant, so as to form a deep-drawn blank including a head and a skirt, having a rotational symmetry around an axial direction, c) degreasing the deep-drawn blank, so as to remove the remainder of the drawing lubricant, in order to form a degreased blank capable of being lacquered, and d) lacquering the degreased blank, wherein the deep-drawn blank is subjected during the degreasing step c) to an energy radiation emission treatment of selected intensity and duration so as to eliminate or break down the remaining lubricant, the treatment being carried out entirely at a metal temperature of less than 150° C., and for a time typically less than 1 second, so as to obtain, after the treatment, a surface tension equal to at least 33 dynes/cm.

2. The method according to claim 1, wherein the energy radiation treatment is a treatment including the formation of a plasma or an ionic or electronic discharge.

3. The method according to claim 2, wherein the treatment is a treatment typically using a high electric field equal to at least 5 kV, and a high-frequency current equal to at least 10 kHz.

4. The method according to claim 3, wherein the treatment is performed using a lateral electrode and a frontal electrode for emission of the discharge, wherein the lateral electrode is parallel to the skirt and reaches and treats the skirt, and wherein the frontal electrode is substantially perpendicular to the lateral electrode and parallel to the head and reaches and treats the head.

5. The method according to claim 4 wherein the lateral electrode and the frontal electrode include an electrically-conductive metal core covered with a dielectric ceramic layer.

6. The method according to claim 4, wherein the treatment is carried out with a potential difference between the electrodes and the deep-drawn blank ranging from 10 to 30 kV, so as to form the high electric field, wherein the electrodes are brought to a potential of 10 to 30 kV and the blank is at the ground or at a zero potential, the potential difference serving to regulate the intensity of the treatment, and wherein the electrodes are at a distance "d" from the surfaces of the blank to be treated, and wherein the distance "d" is less than 4 mm.

7. The method according to claim 6, wherein the lateral electrode is arranged so that it is parallel to a generatrix of the skirt, so that, by rotation of the blank, the entirety of the skirt is subjected to the energy radiation emitted by the lateral electrode, uniformly over the entire height of the skirt.

8. The method according to claim 7, wherein the rotation of the blank involves 1 to 2 rotations, during a time of no more than 1 second.

9. The method according to claim 4, wherein the electrode is a cylindrical electrode with an exterior diameter ranging from 15 mm to 20 mm, and with a length ranging from 100 to 150 mm, with a metal core having a length ranging from 50 to 90 mm, the electrode including an external dielectric ceramic layer or sheath having a thickness ranging from 0.5 to 3 mm.

10. The method according to claim 1, wherein the treatment is performed at atmospheric pressure.

11. The method according to claim 1, wherein the lubricant includes a volatile organic solvent and a lubrication compound capable of breaking down rapidly under the action of the treatment.

12. The method according to claim 11, wherein the lubrication compound is a paraffin oil.

13. The method according to claim 1, wherein the lacquering step includes a spray-painting step in which the entirety of an external surface of the degreased blank is covered with a lacquer by application with a spray-paint gun, so as to form a lacquered blank.

14. The method according to claim 13, wherein the spray-painting step is followed by a first "dust-free" drying step at a temperature below 100° C. for a time of less than 2 minutes, so that the lacquered blank can then be directly decorated or printed.

15. The method according to claim 13, wherein, between the degreasing step and the spray-painting step, a time $\Delta t$ of less than one minute passes.

16. The method according to claim 1, wherein the lacquered blank is printed, by screen printing, on its skirt and then subjected to a second drying operation at a temperature of approximately 140° C., for a time of less than four minutes, so as to obtain a printed cap.

17. The method according to claim 1, wherein a relief pattern is formed on the head of the blank or of the printed cap, the relief pattern being formed with a punch-and-die set having the pattern.

18. The method according to claim 1, wherein the aluminum of the flat blanks is of the 8000 series, with a temper ranging from ¼ hard temper to ¾ hard temper, and with a thickness ranging from 0.18 mm to 0.30 mm.

19. The method according to claim 1 further comprising a finishing step, and wherein the finishing step includes at least one of the additional means selected from the group consisting of:

the incorporation of a seal ring, the incorporation of a screw insert, the formation of means for facilitating a first opening.

20. The method according to claim 1, wherein the electrode is placed at a distance "d" from the blank of approximately 0.2 to 4 mm.

21. Use of the method according to claim 1 to form sealing caps or oversealing caps.

* * * * *